US005735430A

United States Patent [19]

Gorman

[11] Patent Number: 5,735,430

[45] Date of Patent: Apr. 7, 1998

[54] UNDERGROUND STORAGE CONTAINER

[76] Inventor: Dewitt Y. Gorman, P.O. Box 266935, Houston, Tex. 77207

[21] Appl. No.: 513,484

[22] Filed: Aug. 10, 1995

[51] Int. Cl.[6] ..... B65D 41/04

[52] U.S. Cl. ..... 220/484; 220/202; 220/327; 220/256

[58] Field of Search ..... 220/484, 202, 220/203.01, 327, 328, 256

[56] References Cited

U.S. PATENT DOCUMENTS

| | | | |
|---|---|---|---|
| 372,244 | 10/1887 | Walker . | |
| 3,369,321 | 2/1968 | Blackistone, Jr. | 220/484 |
| 3,513,605 | 5/1970 | Smith | 52/20 |
| 3,672,103 | 6/1972 | Kost | 52/19 |
| 4,230,234 | 10/1980 | Taylor | 220/18 |
| 4,665,668 | 5/1987 | Serpico | 52/169.2 |
| 5,117,593 | 6/1992 | Tiernan | 52/20 |
| 5,353,206 | 10/1994 | Fejes | 362/154 |

*Primary Examiner*—Joseph M. Moy
*Attorney, Agent, or Firm*—Matthews & Associates, L.L.P.

[57] ABSTRACT

An underground storage container for the storage of personal valuables and possessions to protect such items from theft, fire, riots and natural disasters. A generally cylindrical tapered container, made preferably of fiberglass, is hermetically sealed through the employment of seals and a cover designed to mate with corresponding flanges on the upper portion of the container's body. The underground storage container has a vacuum release mechanism to facilitate opening and closing the container and a raised spiral auger around the base of the container to assist in anchoring the underground storage container and facilitating its extraction upon removal.

20 Claims, 3 Drawing Sheets

UNDERGROUND STORAGE CONTAINER

FIELD OF THE INVENTION

This invention relates generally to storage containers, and more particularly, to such containers used for underground storage of personal valuables and belongings.

BACKGROUND OF THE INVENTION

With the nationwide arrest rate for burglaries currently down to 13%, the odds clearly do not favor a person deprived of his or her valuables through a burglary from ever regaining possession of them. As thieves have become more sophisticated, elaborate home protection systems, expensive above-ground safes, containers designed to look like household items such as aerosol cans, and many other means for protecting valuables have been developed, but none have been completely successful in foiling attempted thefts by determined burglars. In addition, both manmade and natural disasters such as riots, fires, floods, storms, and earthquakes can easily destroy above ground structures, leaving their contents vulnerable to would-be thieves.

Furthermore, the mere knowledge that someone is utilizing a protective device is often enough to pique a thief's curiosity once that device is located, even though the thief is not yet aware of its contents. This problem emphasizes the necessity of concealing the items to be protected such that not only are they themselves inconspicuous to a would-be thief, but more importantly, such that the device containing them is also similarly inconspicuous. Therefore, one of the safest places to conceal and protect items of value is beneath the ground, in containers designed and buried such that they are virtually undetectable. The present invention thus completely eliminates the problem of arousing a thief's curiosity.

The ease of installation and extraction, ruggedness, and economy of the present invention, coupled with its imperviousness to water and the weather, make this invention an economical alternative to those wishing to ensure the safety of their valuables or items in their possession.

SUMMARY OF THE INVENTION

It is therefore an object of this invention to provide a secure underground storage container for valuable property.

It is another object of this invention to provide a hermetically sealed underground storage container. The present invention solves the problems presented by the infiltration of air and water into the container by virtue of a dual seal, wherein both an outer and inner seal are employed to seal in the contents. The two seals are designed to complement each other in that the outside seal is made from ethylene propylene rubber (EPDM), which is well known for its excellent ozone, weather, and water resistance, while the inside seal is made from Buna-N rubber (Nitrile), which has excellent oil resistance. This invention's design has been proven air-tight through extensive testing at temperatures and pressures well beyond those that will be encountered in normal use.

It is a further object of this invention to provide an underground storage container which is securely anchored in the ground during use, but which is easily extractable when necessary.

The present invention solves the dual problem of the initial anchoring of the container into the ground and the later extraction through the use of both a tapered configuration and an auger at the base of the container. The auger allows the container to be twisted so that the container digs into the walls of the hole in which it is installed, much the same as a wood screw is screwed into a piece of wood. Once buried, the auger serves to secure the container in the ground, thereby preventing floatation forces which may force the container upward. The auger, coupled with this invention's tapered shape, also serves to simplify the extraction of the invention by rotating the invention in the opposite direction.

Furthermore, the present invention provides a vacuum breaking device to solve problems in opening the container which may be caused by differences between internal and external pressures.

It is another object of this invention to be concealable underground in a manner which greatly reduces any chances of detection.

It is yet another object of this invention to provide a ragged and reliable, yet economical alternative to expensive over-ground vaults.

DETAILED DESCRIPTION OF THE DRAWINGS

Figure 1:
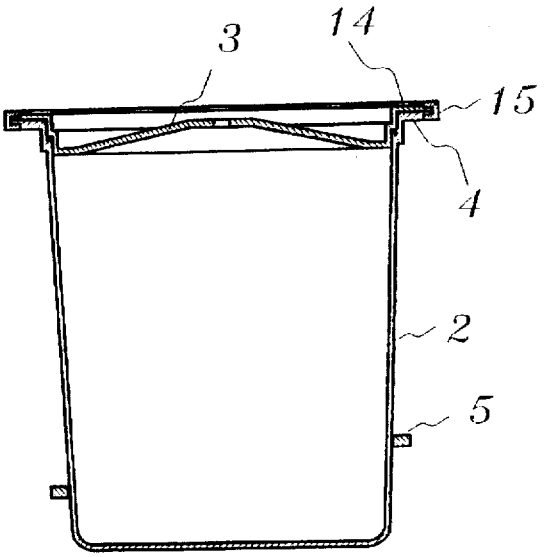
FIG. 1 is a section view illustrating an underground storage container in accordance with the present invention.
Figure 7:
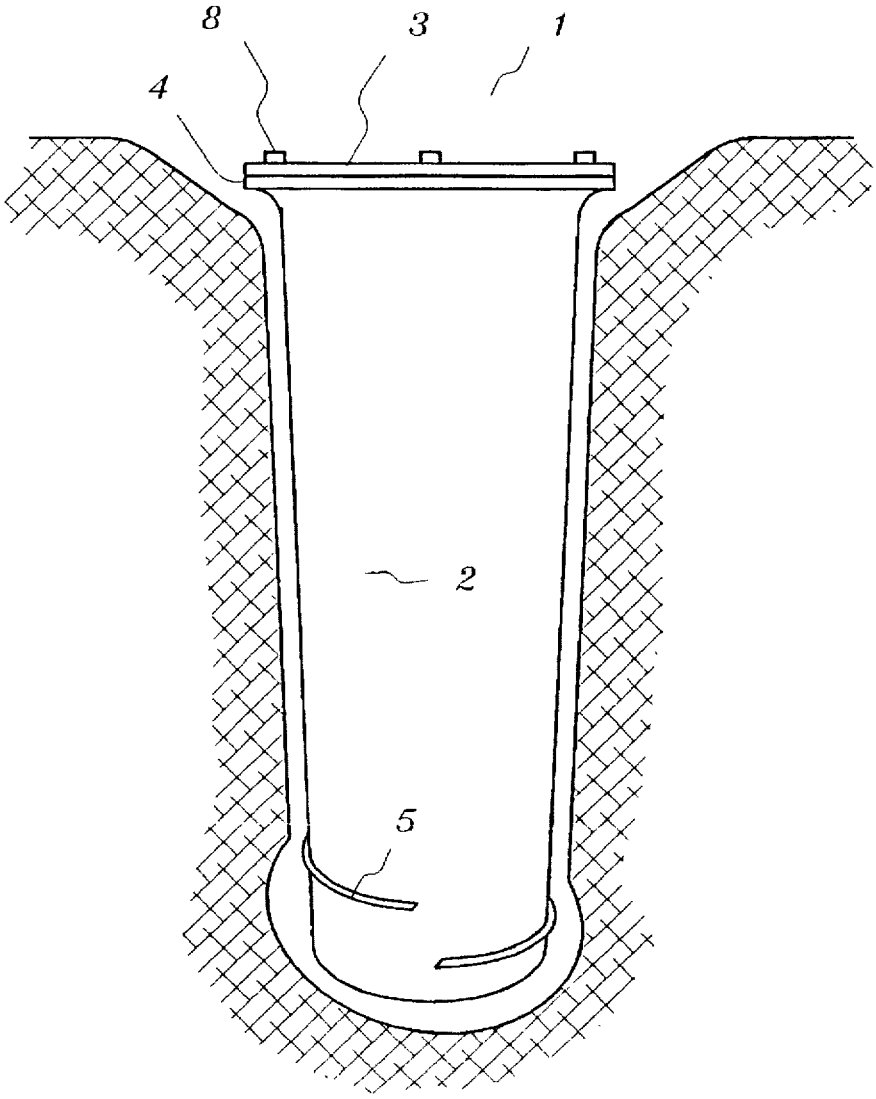
FIG. 7 is a side view of one embodiment of the invention as installed in the ground.

Referring to FIGS. 1 and 7, an underground storage container is generally indicated by the numeral 1. As shown in FIG. 1, the underground storage container 1 is designed to be buried in a pre-formed hole in the ground of a depth greater than the height of the underground storage container 1.

Figure 2:
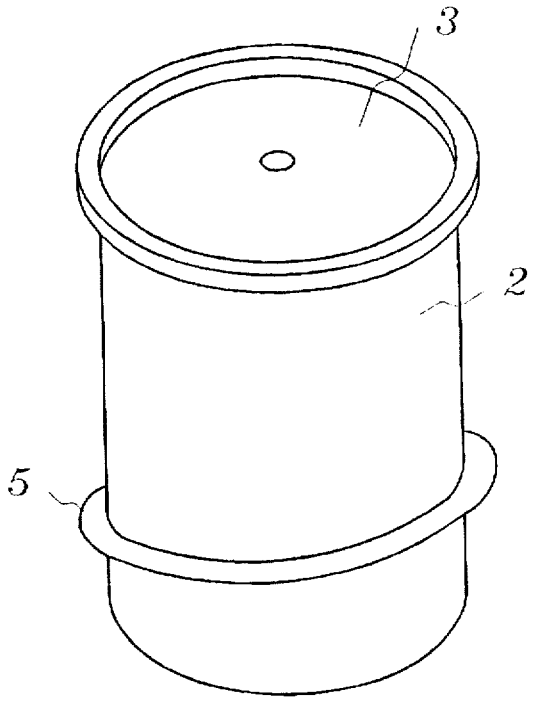
FIG. 2 is a perspective view of the body portion of the underground storage container.
Figure 3:
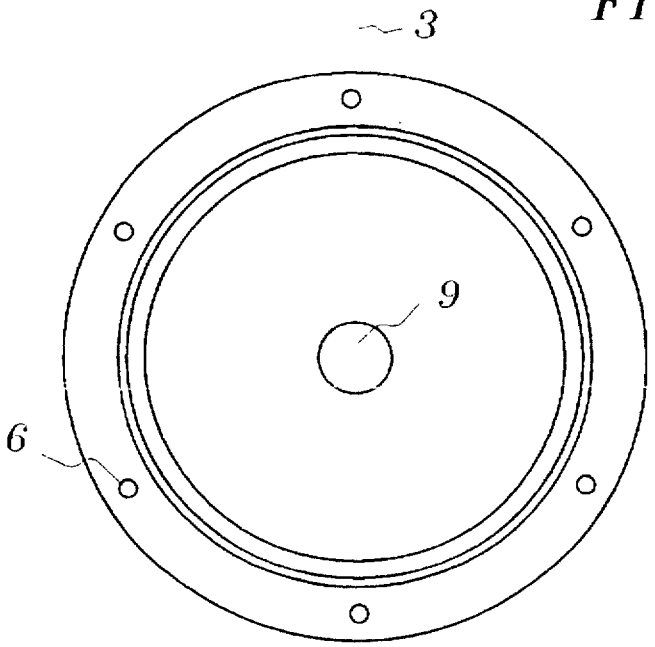
FIG. 3 is a top plan view of one embodiment of the cover of the underground storage container.

Referring to FIG. 2, the two main parts comprising the inventive device are a body generally indicated by numeral 2 and a mating cover, whose top view is illustrated in FIG. 3 and generally indicated by the numeral 3. Furthermore, hole 7 is located in the center of cover 3 to accommodate pressure release bolt 9 shown in FIG. 4.

In a preferred embodiment, the body 2 is made of plastic composites, such as woven fiberglass and resin and has a generally cylindrical shape, with a closed bottom and an open top. Body 2 also has a flange 4 around the open top and a 360° protruding upward spiral (auger) 5 with its lowest point near the base of body 2. Body 2 is tapered such that its largest diameter is at the point where it joins flange 4 and its smallest diameter is just below the lowest point of the auger 5. In a preferred embodiment, the mating cover 3 is also made of plastic composites and has a generally round configuration.

Figure 5:
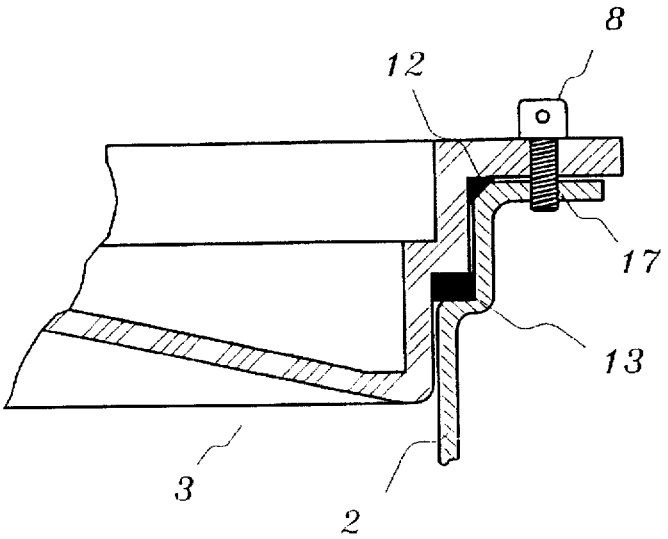
FIG. 5 is an enlarged view of a side of the cover of the underground storage container shown in FIG. 4.
Figure 6:
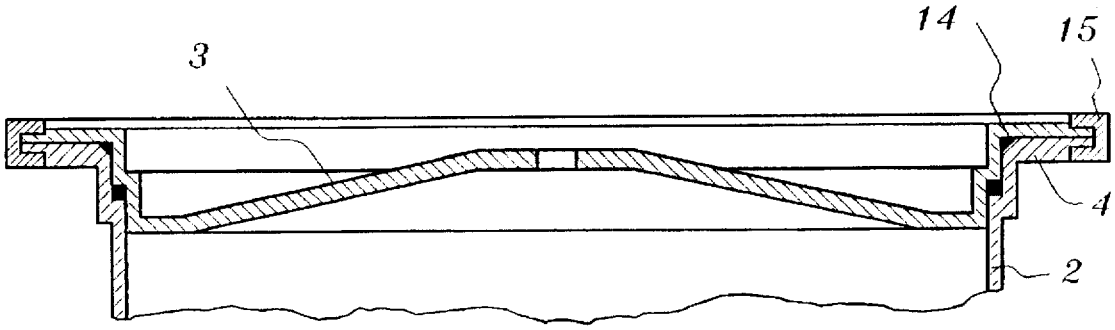
FIG. 6 is a cross section view of the cover of the underground storage container in the preferred embodiment.

As shown in FIG. 6, the preferred embodiment uses a sealing ring 15 to retain the cover on the container. This sealing ring is a clamping-type ring which is known in the art. The clamping ring is placed around flanges 4 and 14 to hold them together. In an alternate embodiment, shown in FIGS. 3 and 5, the invention utilizes a plurality of equidistant holes 6 which are pre-formed through flange 14 of cover 3 and flange 4 of body 2. Holes 6 are designed such that each hole can accommodate a single bolt 8 used to secure the cover 3 onto body 2.

Figure 4:
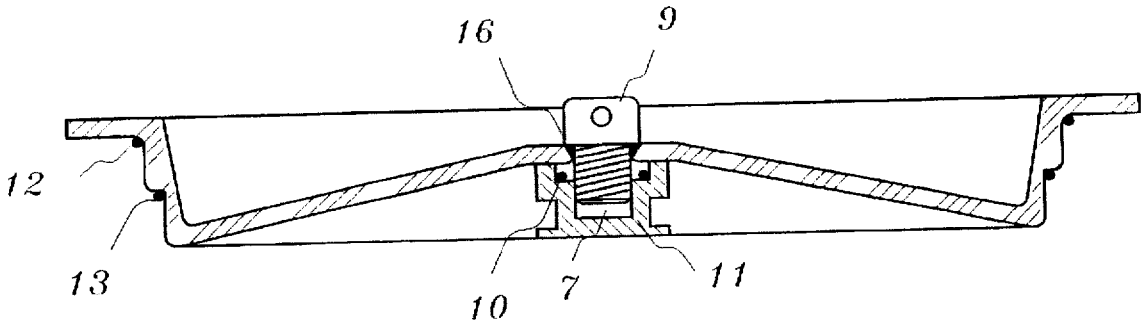
FIG. 4 is a cross section view of the cover of the underground storage container in one embodiment of the invention.

Referring to FIG. 4, a pressure release bolt 9 is shown inserted in cover 3 through hole 7, which serves to release pressure built up inside sealed container 1, thereby facilitating opening or closing container 1 when relative pressures or vacuums develop inside the underground storage container 1. FIG. 4 further illustrates the upper and lower flanges of cover 3 and the preferred location of a tether spool 11. The tether spool can serve as an anchor for strings or lines connected to small items placed out of reach on the bottom of a deep vault or can be used to suspend a drying agent on the inside of the container 1. Pressure release bolt 9 is retained in hole 7 by threading it first into outer pressure release seal 16, then through hole 7, then through inner pressure release seal 10, and finally screwing it into the female threads of tether spool 11. FIG. 4 also shows the arrangement of outer seal 12, which is installed against the upper flange 4 of cover 3 while an inner seal 13 is installed against the lower flange of cover 3.

FIG. 5 is an enlarged cross section of a top side of the underground storage container 1 showing how cover 3 mates with the open top of body 2 and how outer seal 12 and inner seal 13 fit between the cover 3 and body 2. In this embodiment of the inventive device, a plurality of bolts 8, one of which is shown in FIG. 5, are used to ensure a tight fit between cover 3 and body 2, by inserting bolt 8 through hole 6 in cover 3 and screwing bolt 8 into the matching holes 17 located on flange 4.

As described above, the invention is preferably made from plastic composites, such as polyester resins with glass or carbon fibers. The invention also contemplates construction from other materials which would be obvious to one of ordinary skill in the art. These other materials may include simple plastics (e.g., PVC or acrylics), metals (e.g., stainless steel) and numerous other materials. Preferably, the material is homogeneous and is non-corroding or has been treated so as not to corrode. Similarly, the invention contemplates various shapes aside from the slightly tapered cylindrical shape of the preferred embodiment as well as various embodiments of augers, such as shortened or rounded protrusions. The invention further contemplates options such as the use of rust inhibitors or preventatives, removable liners, lockable covers, desiccants or other drying agents, and extraction tools to assist in removing the underground storage container from a buried position. Thus, the invention contemplates numerous variations and embodiments not specifically described herein which will nevertheless be obvious to those skilled in the art.

What is claimed is:

1. An underground storage container for safeguarding and protecting valuable items from weather damage comprising:

a hollow container having an upper end and a lower end, said upper end having an opening therein;

a cover which mates sealingly within said opening to isolate the interior of said container from the exterior of said container, said cover forming a hole therethrough;

means for connecting said cover to said container;

a vacuum release mechanism disposable within said hole for connecting to said cover, said vacuum release mechanism having a first position allowing fluid communication through said hole between the interior of said container and the exterior of said container for eliminating pressure differentials between the interior of said container and the exterior of said container facilitating opening and closing of said cover on said container, said vacuum release having a second position preventing fluid communication between the interior of said container and the exterior of said container through said hole for sealing said container; and an auger affixed to the exterior of said container for securing said container in the ground during installation.

2. The underground storage container of claim 1, wherein said vacuum release mechanism includes:

an outer pressure release seal connected about an interior perimeter of said hole formed by said cover; and a pressure release bolt threaded into said hole and said outer pressure release seal when said vacuum release mechanism is in said second position.

3. The underground storage container of claim 2, wherein said vacuum release mechanism further includes:

a spool having a threaded hole;

an inner pressure release seal connected about an interior perimeter of said threaded hole, wherein when said vacuum release mechanism is in said second position when said pressure release valve is threaded through said outer pressure release seal, through said hole, through said inner pressure release seal and into said threaded hole of said spool.

4. The underground storage container of claim 1, further including:

a first flange integral to and extending around the outer edge of said cover; and a second flange integral to and extending around the outer edge of said container about said opening, wherein, said first flange overlaps said second flange when said cover is mated with said container.

5. The underground storage container of claim 4, further including:

a seal disposed between said first flange and said second flange.

6. The underground storage container of claim 4, further including:

an outer seal disposed between said first and said second flange; and an inner seal disposed between said first and said second flange.

7. The underground storage container of claim 4, wherein said connecting means includes:

a clamping sealing ring connectable about, said first and said second flange for holding said flanges in close contact.

8. The underground storage container of claim 5, wherein said connecting means includes:

a clamping sealing ring connectable about said first and said second flange for holding said flanges in close contact.

9. The underground storage container of claim 6, wherein said connecting means includes:

a clamping sealing ring connectable about said first and said second flange for holding said flanges in close contact.

10. The underground storage container of claim 4, wherein said connecting means includes:

a plurality of bolts connectable between said first flange and said second flange for mating said cover over said opening of said container.

11. The underground storage container of claim 5, wherein said connecting means includes:

a plurality of bolts connectable between said first flange and said second flange for mating said cover over said opening of said container.

12. The underground storage container of claim 6, wherein said connecting means includes:

a plurality of bolts connectable between said first flange and said second flange for mating said cover over said opening of said container.

13. An underground storage container for safeguarding and protecting valuable items from weather damage comprising:

an elongated hollow container having a upper flange end defining an opening and a closed lower end;

a cover having a first flange formed about the outer edge thereof, said cover defining a threaded hole therethrough;

means for connecting said cover to said container;

an auger affixed to the exterior of said container for securing said container in the ground during installation and facilitating the removal of said container; and a vacuum release mechanism connectable to said cover via said cover hole having a first position allowing fluid communication between an interior of said container and the exterior thereof for equalizing pressure therebetween facilitating connection and removal of said cover and a second position whereby fluid communication is prevented through said cover hole, said vacuum release mechanism comprising:

an outer pressure release seal connected about an interior perimeter of said cover hole;

a spool having a threaded hole;

an inner pressure release seal connected about an interior perimeter of said threaded hole of said spool, wherein when said vacuum release mechanism is in said second position when said pressure release valve is threaded through said outer pressure release seal, through said hole, through said inner pressure release seal and into said threaded hole of said spool.

14. The underground storage container of claim 13, further including:

a seal disposed between said first flange of said cover and said upper flange end of said container.

15. The underground storage container of claim 13, further including:

an outer seal disposed between said first flange of said cover and said upper flange end of said container; and an inner seal disposed between said first flange of said cover and said upper flange end of said container.

16. The underground storage container of claim 14, wherein said connecting means includes:

a clamping sealing ring connectable about said first flange of said cover and said upper flange end of said container for holding said flanges in close contact.

17. The underground storage container of claim 15, wherein said connecting means includes:

a clamping sealing ring connectable about said first flange of said cover and said upper flange end of said container for holding said flanges in close contact.

18. The underground storage container of claim 14, wherein said connecting means includes:

a plurality of bolts connectable between said first flange of said cover and said upper flange end of said container for mating said cover over said opening of said container.

19. The underground storage container of claim 15, wherein said connecting means includes:

a plurality of bolts connectable between said first flange of said cover and said upper flange end of said container for mating said cover over said opening of said container.

20. An underground storage container for safeguarding and protecting valuable items from weather damage comprising:

an elongated hollow container having a upper flange end defining an opening and a closed lower end;

a cover having a first flange formed about the outer edge thereof, said cover defining a threaded hole therethrough;

means for connecting said cover within said hole of said container;

at least one seal disposed between said upper flange end of said container and said first flange of said cover;

an auger affixed to the exterior of said container for securing said container in the ground during installation and facilitating the removal of said container; and a vacuum release mechanism connectable to said cover via said cover hole having a first position allowing fluid communication between an interior of said container and the exterior thereof for equalizing pressure therebetween facilitating connection and removal of said cover and a second position whereby fluid communication is prevented through said cover hole, said vacuum release mechanism comprising:

an outer pressure release seal connected about an interior perimeter of said cover hole;

a spool having a threaded hole;

an inner pressure release seal connected about an interior perimeter of said threaded hole of said spool, wherein when said vacuum release mechanism is in said second position when said pressure release valve is threaded through said outer pressure release seal, through said hole, through said inner pressure release seal and into said threaded hole of said spool.

* * * * *